United States Patent [19]

Martinez et al.

[11] Patent Number: 4,828,004

[45] Date of Patent: May 9, 1989

[54] DOOR STRUCTURE FOR GARAGE DOORWAYS

[76] Inventors: Robert A. Martinez, 4127 S. Wolff St.; Robert D. Bohnas, 5102 W. Union Ave., both of Denver, Colo. 80236

[21] Appl. No.: 131,312

[22] Filed: Dec. 8, 1987

Related U.S. Application Data

[63] Continuation of Ser. No. 736,293, May 20, 1985, abandoned, which is a continuation of Ser. No. 576,201, Feb. 2, 1984, abandoned, which is a continuation of Ser. No. 229,510, Jan. 29, 1981, abandoned.

[51] Int. Cl.[4] ..... E06B 3/70

[52] U.S. Cl. ..... 160/229.1; 160/201

[58] Field of Search ..... 160/229.1, 201; 49/501; 52/455

[56] References Cited

U.S. PATENT DOCUMENTS

| | | | |
|---|---|---|---|
| 2,916,089 | 12/1959 | D'Orazio | 160/201 |
| 2,928,462 | 3/1960 | Neisewander | 160/229 R |
| 2,931,435 | 4/1960 | Neisewander | 160/229 R |
| 3,178,776 | 4/1965 | Stansberry | 160/229 A |
| 3,221,465 | 12/1965 | McKee | 160/229 A |
| 3,347,305 | 10/1967 | Urbanick | 160/201 X |
| 3,402,457 | 9/1968 | Landow et al. | 160/229 R |
| 3,527,283 | 9/1970 | Butler et al. | 160/229 R |
| 3,744,826 | 7/1973 | Hawes | 52/468 |
| 3,996,705 | 12/1976 | Gutierrex | 160/231 A |
| 4,144,924 | 3/1979 | Vanden Hoek | 160/231 A |
| 4,236,365 | 12/1980 | Wheeler | 52/455 |

*Primary Examiner*—Robert W. Gibson, Jr.
*Assistant Examiner*—David M. Purol
*Attorney, Agent, or Firm*—John E. Reilly

[57] ABSTRACT

Door structure particularly suited for closing garage doorways and a method of making same include top and bottom preformed, weather-resistant metal rails (16, 17) on a single-piece, preformed, weather-resistant panel (11), together with stiles (19) along the back of the panel fastened at the ends to opposed fastening flange sections of the rails to form a strong unitary structure that is readily joined by conventional hinges into a sectional garage door. Two or more of the above described doors are joined side by side by single top and bottom rails and a flexible cover molding (62) adjacent inner ends for closing wider garage doorways.

6 Claims, 3 Drawing Sheets

46b
46a
48
45
42
46
44
41
16
43
36
19
31
32
58
54
56
56b
37
56a
17
51
21
46
16
48
10
56
17

60
11
19
62
11

34
11c
19
11b
11a
11

16
62
60
A
7
7
A
17
16
A
62
A 19
10
31
11
32
31
32
19

DOOR STRUCTURE FOR GARAGE DOORWAYS

This application is a continuation application of Ser. No. 736,293, filed 20 May 1985, now abandoned, which is a continuation of Ser. No. 576,203, filed 2 Feb., 1984 now abandoned, which is a continuation of Ser. No. 229,510 filed 29 Jan., 1981, now abandoned, for DOOR STRUCTURE FOR GARAGE DOORWAYS AND METHOD OF MAKING SAME, invented by Robert A. Martinez et al.

TECHNICAL FIELD

This invention relates to a novel door structure that is particularly suited for closing a garage doorway and to a method of making same.

BACKGROUND ART

Garage doors currently in use, in general, are made up of a plurality of panels arranged one above another and hingedly connected at meeting top and bottom rails to pivot relative to one another as the door is raised and lowered. The construction of these panels includes a relatively large number of wooden pieces including top and bottom wooden rails and upright wooden stiles which are joined in a rectangular framework at tongue and groove joints, together with a plurality of hardboard sheets that fit into inside grooves formed in the wooden rails and intermediate wooden stiles to close the central area of the rectangular framework.

Among the problems encountered with such garage door structures is the unavailability of suitable wood, the cost of wood, the tendency of wood to warp, the maintenance requirements for painted wood, and a strength deficiency in wooden rails. This prior art garage door construction also involves considerable cutting, a number of edge shaping steps, and relatively complex machinery to assemble and fasten the pieces into a completed panel.

DISCLOSURE OF INVENTION

In accordance with the present invention there is provided a door structure characterized by a preformed, weather-resistant panel, preformed, weather-resistant top and bottom strip metal rails of a special configuration mounted thereon, and a backing structure such as upright wooden stiles disposed on the back face of the panel connected at upper and lower ends to opposed, rearwardly extending, fastening flanges on the strip rails to interconnect the panel, rails and stiles as a simple, strong, unitary door structure that is readily assembled in different sizes and shapes. A single top and bottom rail extends along two or more of the panels arranged side by side and a flexible cover molding covers the space between adjacent side portions.

BRIEF DESCRIPTION OF DRAWINGS

The details of this invention will be described in connection with the accompanying drawings, in which.

DETAILED DESCRIPTION

Figure 1:
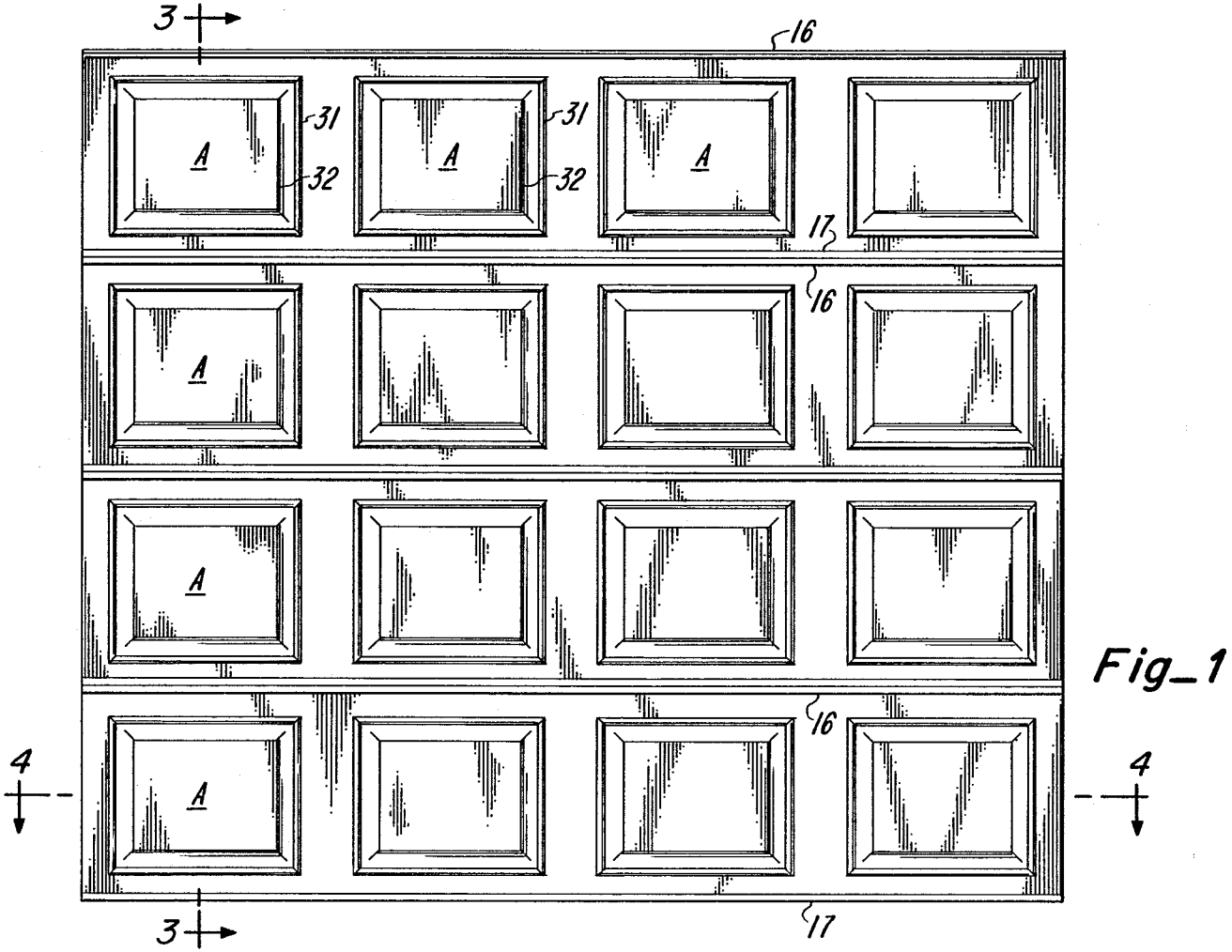
FIG. 1 is a front elevation view of a door structure embodying features of the present invention.
Figure 2:
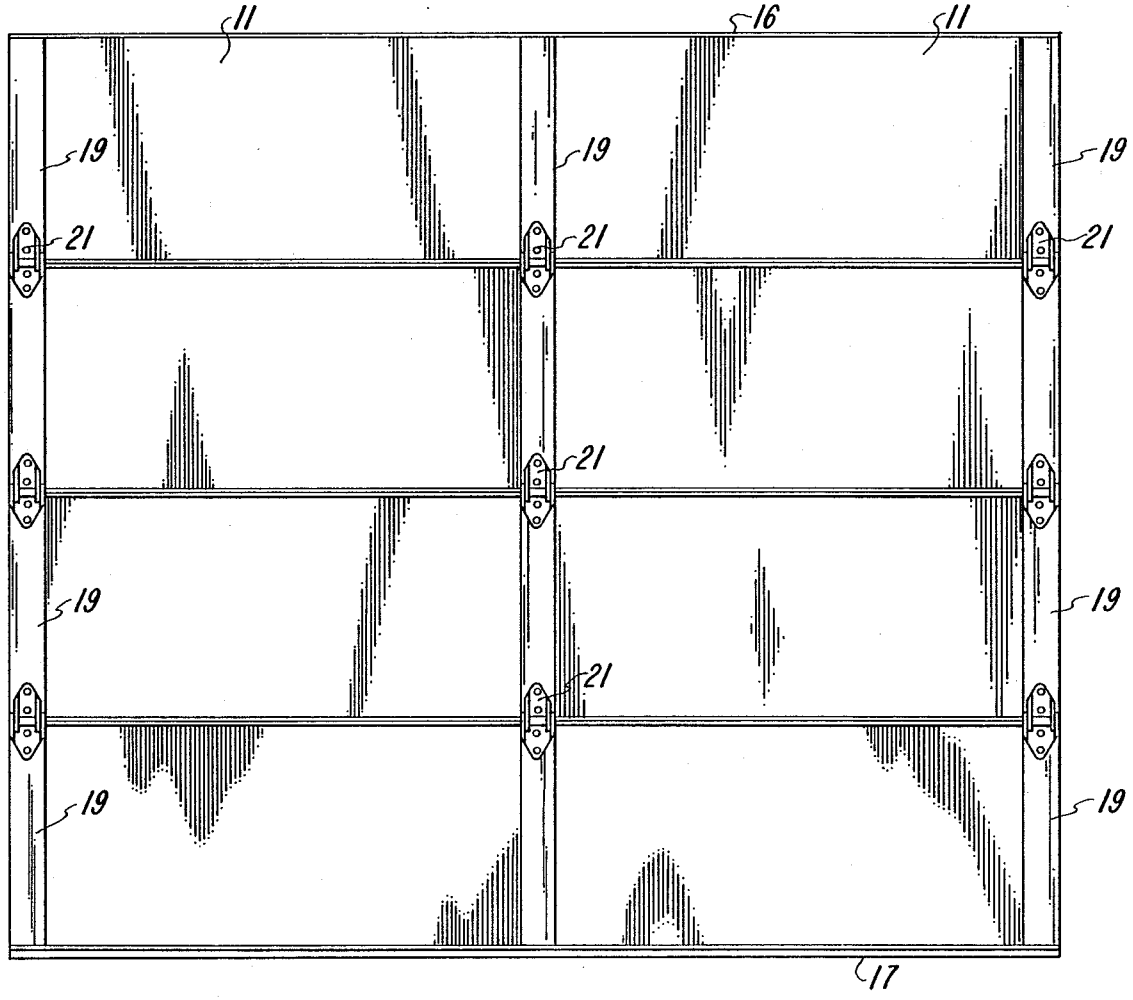
FIG. 2 is a rear elevation view of the door structure shown in FIG. 1.

The garage door 10 shown in FIGS. 1-5, which is particularly suited for closing a conventional 8-foot garage doorway, includes four identical panels, each designated by the numeral 11, that are stacked or arranged one above the other and disposed in a common plane.

A metal top rail 16 is mounted oh the top edge of each panel 11 and extends the full length thereof and a metal bottom rail 17 is mounted on the top edge of each panel 11 and extends the full length thereof.

A plurality of laterally spaced upright backing members or stiles 19 are mounted on the back of the panel. Conventional garage door hinges 21 mount on the stiles 19 to pivotally join adjacent of the panels together at meeting rails to pivot as the door is raised and lowered in a conventional manner. For the door shown there are three hinges for joining two panels together, one at each end and one in the middle.

The term "preformed, weather-resistant" as used herein means that the part is made weather-resistant prior to assembly and does not need to be painted or the like.

A structure that has been found particularly suitable for providing a preformed, weather-resistant panel is a mat-formed phenol bonded wood particle board core **11*a* having an overlay sheet 11*b* on the front surface and an overlay sheet 11*b*** on the back surface made of a phenolic resin impregnated fiber and sold by the Cladwood Company under the brand name CLADWOOD. In the manufacture of the panel, particles or chips of wood, phenolic type resins, and a fiber overlay are integrally fused by a special process into a composite unit. This panel is preformed with the design therein, is weather-resistant, and is further characterized as a medium density particle board made of coarse wood chips that is substantially impervious to moisture. A preferred thickness for garage doors is ⅜ inch board.

Each panel 11 shown is formed from a generally flat sheet of material with four identical laterally spaced surface designs, each designated A, formed therein. The design shown comprises a raised outer frame section 31 of rectangular shape and a raised center section 32 of rectangular shape that extend in front of all of the other front surfaces of the panel. The latter section 32 extends forwardly beyond the remainder of the front face of the panel.

The top edge portion of the panel 11 is undercut along the back at 36 and this undercut extends the full length thereof to provide a top edge portion of reduced thickness that is of substantially uniform thickness throughout its vertical extent to provide a snug fit for the channel-shaped cap section fitting thereon. Similarly, the bottom edge portion is undercut at 37 and this undercut extends the full length thereof to provide a bottom edge portion of substantially uniform thickness throughout its vertical extent. Since the metal channel-shaped cap sections hereinafter described can be made of a substantially uniform width complementing that of the edge portions of the panel, a close friction fit is provided between these two parts.

The top rail 16 has an inverted channel-shaped top cap section 41 that has an interior space of uniform width throughout its vertical extent and is sized to be complementary to the edge portion of the panel to nest snugly over the top edge portion of the panel. Top rail 16 further has a foldback section 42 that extends back from a bend 43 and along the back leg within the top recessed area 36 in the panel, a flat fastening flange section 44 that projects rearwardly from and in a plane above the base of the cap section 41 to form a forwardly stepped-down top surface 45 along the top edge of the panel, and a raised rear flange portion 46 that extends up and forwardly from the rear marginal edge of the fastening flange section. The raised rear flange portion includes a rear curved section **46*a* and a rear flange section 46*b***.

A screw fastener 48 is shown extending through a hole in the fastening flange section 44 and into the end of the stile 19 to secure the top edge strip to the backing member and in turn to the panel. Preferably two screw fasteners per stile are used at both the top and bottom ends. A preferred material for the stile 19 is wood and a preferred size for the cross section is one inch by two and one-half inches.

The bottom rail 17 has a channel-shaped bottom cap section 51 that nests snugly over the bottom edge portion of the panel in a friction-fitting relation, as does the top cap section, with a flat bottom fastening flange section 54 that extends rearwardly from the rear leg of the channel section, the cap section 51 being a forwardly downturned bottom surface 55 that is complementary to, seats on, and overlaps with the top surface 45 above described of the next lower panel, together with a raised rear flange portion 56 that extends up and forwardly from the rear end of the fastening section 54.

Rear flange portion 56 includes a rear curved section **56*a* and a rear flange section 56*b*. The rear flange sections 46*b* and 56*b*** of adjacent or meeting rails provide substantially horizontal contact surfaces and form a recessed area outwardly of the associated fastening flange section.

A screw fastener 58 is shown extending through a hole in section 54 and into the end of the stile 19 to secure the end of the stile to the bottom rail and in turn to the panel.

Figures 3, 4, 5, 6, 7:
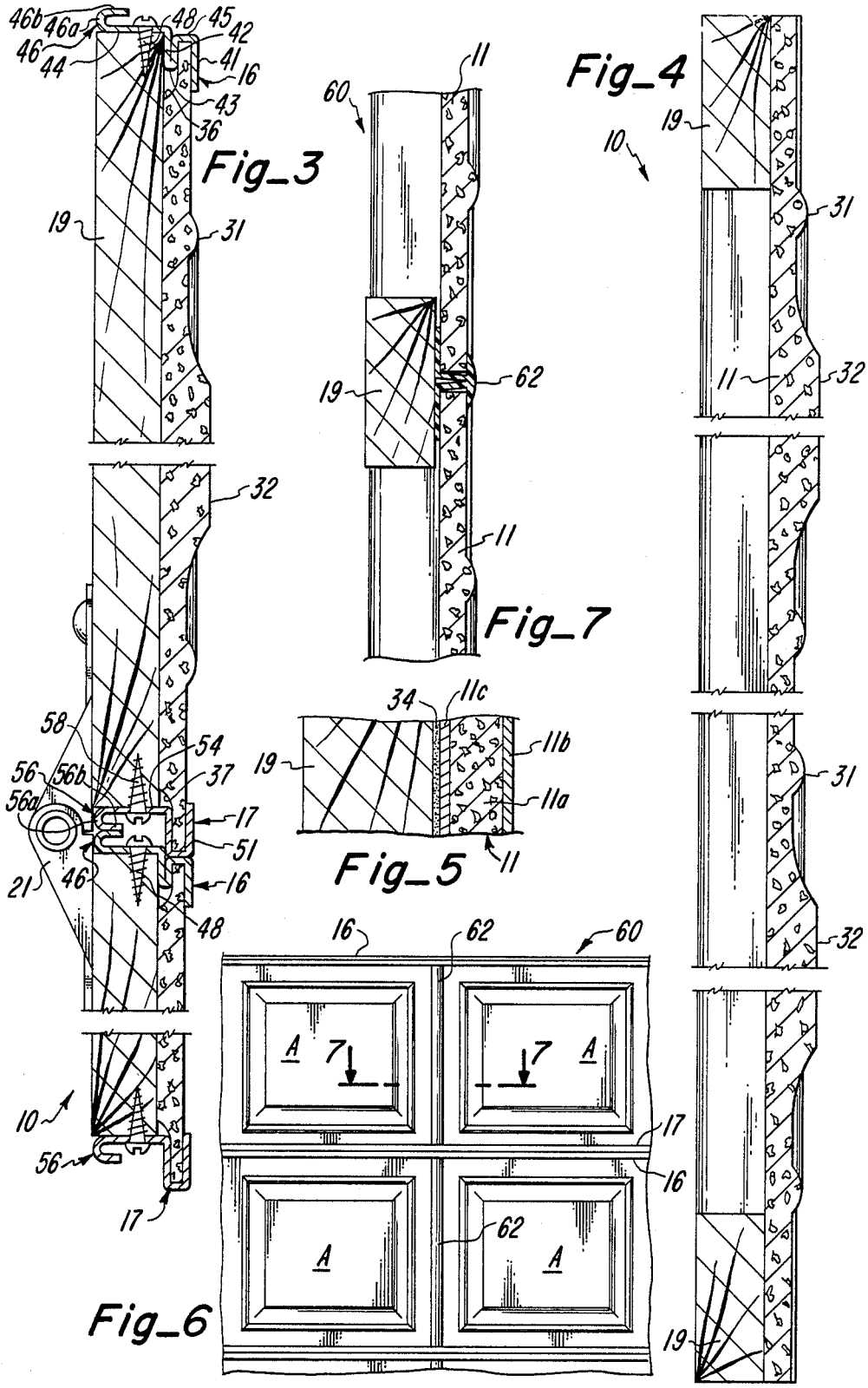
FIG. 3 is a sectional view taken along lines 3—3 of FIG. 1.
FIG. 4 is a sectional view taken along lines 4—4 of FIG. 1.
FIG. 5 is an enlarged sectional view of a portion of a panel shown in FIG. 4 with more detail on preferred types of materials and connections between parts for some applications.
FIG. 6 is a front elevation view of another form of door structure embodying features of the present invention and using two groups of the panels connected side by side.
FIG. 7 is a sectional view taken along lines 7—7 of FIG. 6.

As best seen in FIG. 6, the abutting bottom and top rails have the rear flange sections opposite one another and the cap sections opposite and in line with one another. The raised rear flange portions of the rails form a space that accommodates the heads of the fastening screws and the raised rear flange portions and cap sections of adjacent panels. Preferably the top and bottom rails are made by roll-forming a single piece of galvanized steel strip material such as 18-gauge.

In a preferred construction for some applications a construction adhesive is applied to the edge portions and inside the cap sections of the rails and also between the back of the panel and the stile 19 for added strength.

Figure 8:
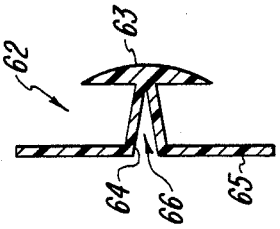
FIG. 8 is an enlarged sectional view of an intermediate molding used in the dual panel arrangement shown in FIGS. 6 and 7.

Referring now to FIGS. 6–8, to accommodate wider door spaces such as a conventional 16-foot garage doorway, two of the above panels 10 are connected to form a wider garage door, generally designated by numeral 60. In this form of the invention two groups of the panels 11 are connected side by side by one-piece top and bottom rails 16 and 17 and a relatively thin cover molding 62, preferably of extruded plastic, fits over the abutting edge portions and extends along both back and front surface areas.

The cover molding 62, as shown in more detail in FIG. 8, has an outer strip portion 63 that forms one leg for two back to back channel portions 65 and 64 connected at adjacent ends to the outer strip portion 63 and extending along diverging angles to provide a V-shaped gap 66 between the opposed channel structure that allows flexure between the two side by side garage doors and covers the gap therebetween.

As best seen in FIG. 5, the top edge strip 16 and bottom edge strip 17 are continuous for the full length of both end to end panels 11, and the molding 62 has its upper end abutting flush with the top edge strip 16 and the lower end abutting flush with the bottom edge strip to provide a neat appearance.

A preferred procedure for assembling the above described door structure is as follows:

(1) The top and bottom edge strips are placed on the top and bottom edges of the panel and a construction adhesive may be applied to abutting surfaces.

(2) The stiles are positioned and metal screws are threaded via the holes in the fastening flanges into the ends of the stiles. A construction adhesive may also be applied between the panel and stiles prior to assembly.

INDUSTRIAL APPLICABILITY

The exterior parts of the above described door structure have been found to be highly weather-resistant, and the parts are readily assembled in a variety of sizes to meet a variety of garage door applications.

Although the present invention has been described with a certain degree of particularity, it is understood that the present disclosure has been made by way of example and that changes in details of structure may be made without departing from the spirit thereof.

What is claimed is:

1. In an overhead garage door structure, the combination comprising:

a plurality of preformed weather-resistant panels, each panel consisting of a mat-formed phenol bonded wood particle board having an overlay sheet on each of the front and back faces thereof composed of a phenolic resin impregnated fiber, top and bottom edge portions of each said panel having portions undercut for a limited distance to be of substantially uniform thickness throughout their vertical extent and of a reduced thickness in relation to the thickness of the rest of said panel, and opposite side edges of each said panel being uncovered;

each panel having preformed, weather-resistant, metal top and bottom rails on said panel, each said rail having a cap section including a channel of substantially uniform width corresponding to the thickness of said undercut portions into which one of said undercut portions on associated top and bottom edge portions of said panel is fully inserted, and a fastening flange section extending rearwardly of each said associated cap section, said top and bottom rails extending substantially the full length of said panel;

backing means mounted on the back face of each said panel extending between the top and bottom fastening flange sections and having opposite ends abutting said top and bottom fastening flange sections; and each panel having first fastening means between said top and bottom fastening flange sections and opposite ends of said backing means for drawing said top and bottom rails firmly against said opposite ends of said backing means and drawing said cap sections against said top and bottom edge portions of each said panel, and second fastening means between said backing means and said panel, said first and second fastening means operative to rigidly and integrally connect said panel, said top and bottom rails and said backing means as one rigid body.

2. In a door structure as set forth in claim 1, wherein each said panel is of a non-metal, one-piece laterally continuous construction, said first fastening means for at least one of said panels including an adhesive applied between said top and bottom fastening flange sections and said opposite ends of said backing means and said second fastening means including an adhesive applied between said backing means and said panel.

3. In a door structure as set forth in claim 1, wherein said first fastening means includes metal screws extending through apertures in said fastening flange sections and into said opposite ends of said backing means and an adhesive between said fastening flange sections and said opposite ends of said backing means.

4. In an overhead door structure for a garage doorway and the like, the combination comprising:

a plurality of similar panels arranged on above the other, each of said panels being of a one-piece, laterally continuous, preformed, weather-resistant construction, each said panel defined by a mat-formed phenol bonded wood particle board having an overlay sheet on the front and back surfaces composed of a phenolic resin impregnated fiber, top and bottom edge portions of each said panel having portions undercut for a limited distance along the back face to be of selected substantially uniform thickness throughout their vertical extent and of a reduced thickness in relation to the thickness of the rest of said panel;

one-piece, preformed, weather-resistant, metal top and bottom rails on each of said panels, each said rail being open at the ends and having a substantially channel-shaped cap section fitted snugly on and rigidly fastened to a top edge portion for the associated panel, a fastening flange section extending rearwardly from a leg of the associated cap section, and a raised rear flange portion extending outwardly away from sand forwardly toward the associated panel from each associated fastening flange section to provide an external, substantially horizontal, contact surface outwardly of said fastening flange section and a recessed area outwardly of said flange fastening section, said rails extending substantially the full length of the associated panel;

a plurality of laterally spaced, upright stiles mounted on the back face of each panel extending between said top and bottom rearwardly extending flanges, each said stile having opposite end portions butting against a pair of opposed surfaces provided by said fastening flange sections associated with each panel; and first fastening means between said top and bottom fastening flange sections and said top and bottom rails firmly against said opposite end portions of said stiles and drawing said cap sections against said top and bottom edge portions of said panels, and second fastening means between said stiles and said panels to integrally connect said stiles, said panels and associated top and bottom rails as one rigid body, said first and second fastening means for at least one of said panels including a construction adhesive applied between said flange sections and said opposite end portions of said stiles and said stiles and said panels, respectively.

5. In a door structure as set forth in claim 4 wherein each of said bottom rails of one panel abuts against one of said top rails of the next lower frame when said panels are coplanar, means pivotally connecting said panels to one another at said adjacent rails with a portion of said bottom rail overlapping a portion of said top rail of each next lower panel, the fastening flange section of each bottom rail of adjacent panels is directly opposite and spaced from the fastening flange sections of the top rail of the next lower panel.

6. In an overhead door structure, the combination comprising:

first and second group of panels, each group of panels having a plurality of similar panels arranged one above the other, each of said panels defined by a mat-formed phenol bonded wood particle board having an overlay sheet on each of the front and back faces thereof composed of a phenolic resin impregnated fiber, top and bottom edge portions of each said panel having portions undercut for a limited distance to be of substantially uniform thickness throughout their vertical extent and of a reduced thickness in relation to the thickness of the rest of said panel, said first and second groups being side by side in a common plane;

preformed, weather-resistant, metal top and bottom rails on each of said panels, each of said rails being open at the ends and having channel-shaped section fitted snugly on and rigidly fastened to an associated top and bottom edge portion of an associated panel and a fastening flange extending rearwardly from an associated cap section substantially the full length of the associated panel;

each of said rails having a raised rear flange portion including a reverse curved rear section extending from a rear edge of each said fastening flange section forwardly over and in spaced relation to said fastening flange section to provide an external, substantially horizontal, contact surface and a recessed area outwardly of said fastening flange section, means pivotally connected adjacent panels with said reverse curved rear sections of adjacent top and bottom rails abutting one another when said panels are coplanar, and said cap section of said top rail overlapping the fastening flange section of said bottom rail and seated on said cap section thereof;

backing means in the form of upright wooden stiles counted on the back face of each said panel extending between the top and bottom fastening flange sections;

first fastening means extending between said top and bottom flange fastening sections and opposite ends of said backing means for drawing said top and bottom rails firmly against said opposite ends of said backing means and drawing said cap sections against said top and bottom edge portions of an associated panel, and second fastening means between said backing means and each said panel to integrally connect each panel and associated top and bottom rails and backing means as one rigid body; and a flexible cover molding having a pair of back to back channel portions pivotally connected along adjoining side edges of adjacent panels, said channel portions gripping adjacent side edge portions of adjacent panels in said first and second groups, each said cover molding extending between associated top and bottom rails of said first and second groups of panels.

* * * * *

UNITED STATES PATENT AND TRADEMARK OFFICE

CERTIFICATE OF CORRECTION

PATENT NO. : 4,828,004

DATED : 9 May, 1989

INVENTOR(S) : Martinez, Robert A. et al

It is certified that error appears in the above—identified patent and that said Letters Patent is hereby corrected as shown below:

| | |
|---|---|
| Column 5, Claim 4, Line 55 | Cancel "sand" and substitute -- and --. |
| Column 6, Claim 4, line 2 | After "and", insert --said opposite end portions of said stiles for drawing--. |
| Column 6, Claim 6, Line 62 | Cancel "counted" and substitute -- mounted --. |

Signed and Sealed this

Thirtieth Day of January, 1990

*Attest:*

JEFFREY M. SAMUELS

*Attesting Officer*

*Acting Commissioner of Patents and Trademarks*

UNITED STATES PATENT AND TRADEMARK OFFICE

CERTIFICATE OF CORRECTION

PATENT NO. : 4,828,004

DATED : 9 May, 1989

INVENTOR(S) : Martinez, Robert A. et al

It is certified that error appears in the above-identified patent and that said Letters Patent is hereby corrected as shown below:

On the face of the patent, after [76] Inventors: etc., insert:

Assignee: Robert A. Martinez, Denver, Colorado

Signed and Sealed this

Seventh Day of August, 1990

*Attest:*

HARRY F. MANBECK, JR.

*Attesting Officer*

*Commissioner of Patents and Trademarks*